United States Patent [19]

Fletcher et al.

[11] 4,077,813

[45] Mar. 7, 1978

[54] METHOD OF PRODUCING COMPLEX ALUMINUM ALLOY PARTS OF HIGH TEMPER, AND PRODUCTS THEREOF

[76] Inventors: James C. Fletcher, Administrator of the National Aeronautics and Space Administration, with respect to an invention of Irvin J. Wilson, Rancho Palos Verdes, Calif.

[21] Appl. No.: 708,771

[22] Filed: Jul. 26, 1976

[51] Int. Cl.[2] ..... C22D 1/04

[52] U.S. Cl. ..... 148/12.7 A; 148/125

[58] Field of Search ..... 148/12.7 A, 125

[56] References Cited

U.S. PATENT DOCUMENTS

| | | | |
|---|---|---|---|
| 1,472,738 | 10/1923 | Archer et al. | 148/125 |
| 2,446,166 | 8/1948 | Eades | 148/125 |
| 2,736,674 | 2/1956 | Harmon | 148/12.7 A |
| 3,113,052 | 12/1963 | Schneck | 148/12.7 A |
| 3,172,787 | 3/1965 | Martenet | 148/12.7 A |
| 3,184,349 | 5/1965 | Burwen | 148/125 |

*Primary Examiner*—W. Stallard

*Attorney, Agent, or Firm*—Carl O. McClenny; John R. Manning; Marvin F. Matthews

[57] ABSTRACT

Fully annealed aluminum sheet is first stretch formed to the complex, doubly compound shape of a previously prepared forming die, e.g., an ejection seat blowout panel of a shuttlecraft. The part is then marked with a series of grid lines for monitoring later elongation. Thereafter it is solution heat treated and refrigerated to retard hardening. While still soft, it is stretched a second time on the same die to induce a modicum of work hardening, after which it is aged to the desired stress corrosion resistant temper, perferrably the T8 level, to provide the desired hardness and stress corrosion resistance.

1 Claim, 2 Drawing Figures

FIG. 1
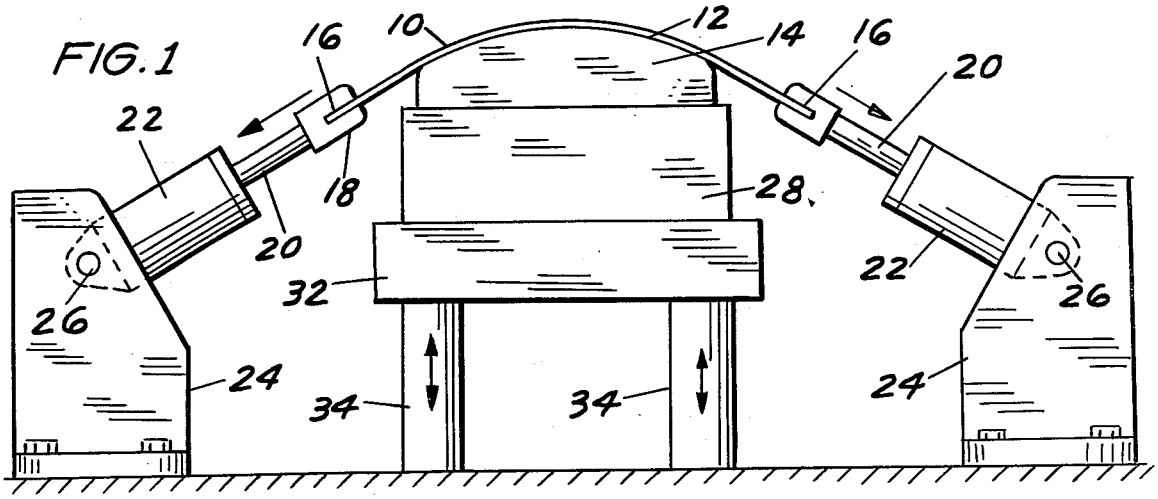
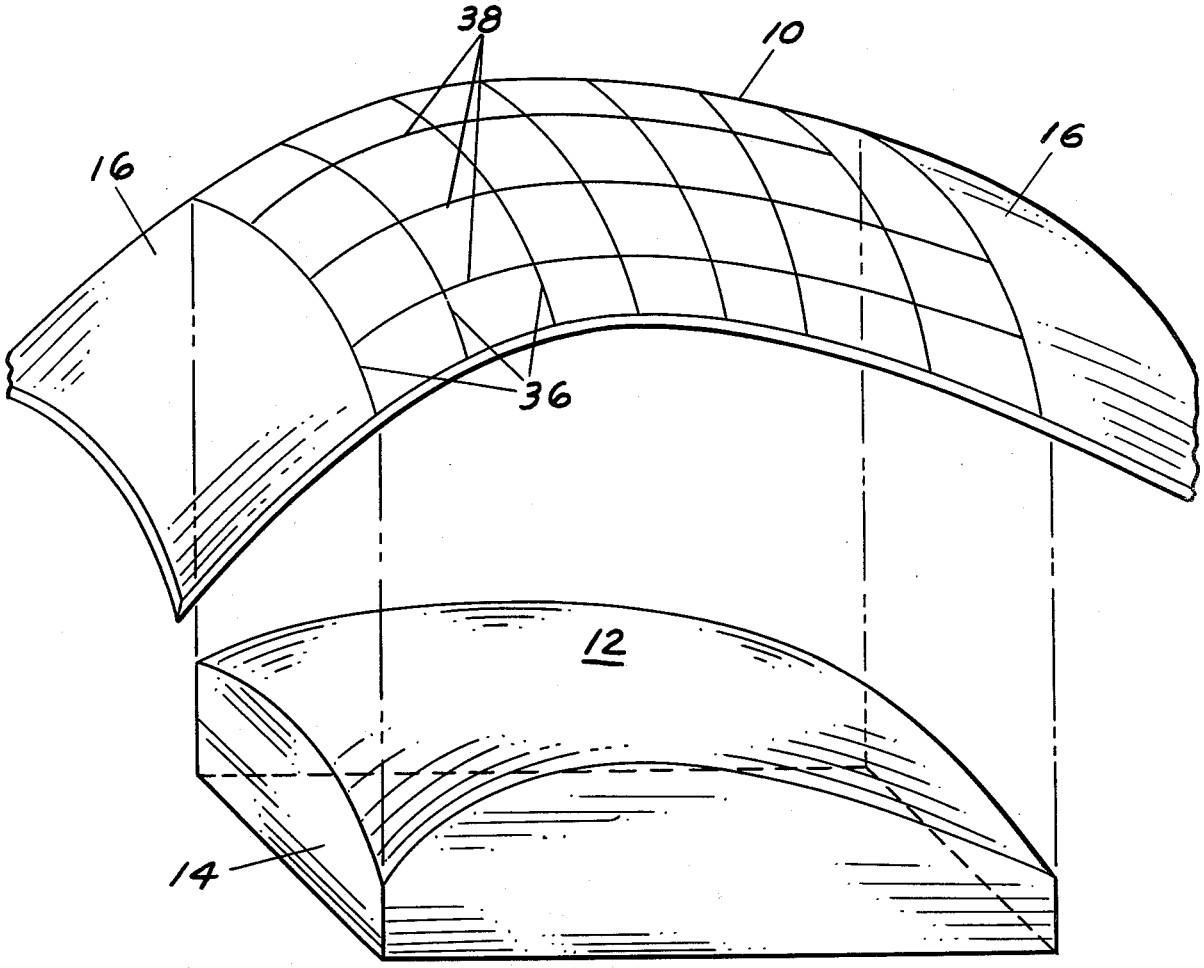
FIG. 2

METHOD OF PRODUCING COMPLEX ALUMINUM ALLOY PARTS OF HIGH TEMPER, AND PRODUCTS THEREOF

ORIGIN OF THE INVENTION

The invention described herein was made in the performance of work under a NASA Contract and is subject to the provisions of Section 305 of the National Aeronautics and Space Act of 1958, Public Law 85-568 (72 Stat. 435; 45 USC 2547).

BACKGROUND OF THE INVENTION

1. Field of Invention

The present invention relates to the aluminum forming and heat treating arts, and more particularly to the aspects of those arts touching upon the production of intricate aluminum alloy parts which must be tough, very hard, and highly resistant to corrosion under stress. Even more specifically the invention deals with aluminum alloy sheets which are processed to become exterior panels of aircraft, spacecraft and shuttlecraft.

2. Prior Art

Since the discovery in the 1910's that most aluminum alloys can be heat treated to vary their physical characteristics, aluminum metallurgists and manufacturers have developed and now make routine use of a widely recognized scale of "tempers", ranging from "O" and "W" in the softest condition to "T8" in the hardest condition, (as used herein, T8 may also mean and includes T81, T851, T8511, etc., and similarly "T3" may also mean and includes T351, T3511, etc). These tempers not only quantify the hardness of the product, but other characteristics as well — for example yield strength, elongation or ductility and stress corrosion resistance. In addition, they generally indicate the previous metallurgical treatment of the aluminum part, and thus give the reader a good idea of the microstructure of the material, such things as grain size, amount of precipitation of intermetallic compounds at the grain boundaries, and the extent to which such compounds have coalesced. Temper designations have become so important that no description of an aluminum alloy part is regarded as complete unless the temper is specified. Thus 2024–O aluminum sheet is one in which known percentages of alloying elements are interspersed in the aluminum matrix and the material has maximum softness and ductility, whereas 2024-T81 aluminum sheet has exactly the same chemical composition but has been heat treated to a very hard condition, making it much more suitable for many applications but at the same time making it much more difficult to form into the desired shape.

The predicament of the present inventor was that he was required to provide a compoundly curved part with a T851 temper (as illustrated in the accompanying drawing), and there was no known procedure for making such parts. It had been customary to form sheets with the as-delivered T351 mill temper to the desired shape and then heat treat them to the hard T851 temper, but in this instance the final form required was so intricate it could not be fabricated from material with a T351 temper.

On the other hand, it was not possible to obtain the desired result by forming the sheets in the "O" condition to the desired shape and then treating them directly to a T851 temper. The maximum temper possible in such procedure is T62, which is closer to the goal but lacks the properties required of the aluminum with a T851 temper.

Neither the prior patented art nor the published technical literature suggested a solution to this problem.

SHORT STATEMENT OF THE INVENTION

The present inventor's solution to the problem may be thought of as the combining of three basic procedures: first, anneal the sheets as delivered and form them to the desired intricate shape, which reduces to only a forming step when annealed sheets are available for purchase; second, cold work the formed part to bring it to the T3 temper; third, and last, use known techniques to bring the part to the T8 temper.

In the first of these steps, the as-delivered heat treated sheet is annealed by customary heating, soaking and cooling steps to obtain a fully annealed sheet after which it is stretch formed to the intricate shape of a prefabricated forming die. Except for very minor changes, this puts the part in essentially its final shape and dimensions. However, even though the cold work increases the hardness of the part, it still lacks the temper finally desired in the finished product.

In the second step, the part is "solution heat treated," a well known heat treatment in which the part is heated to an annealing range, and is then rapidly cooled, usually by immersion in room temperature water. This puts the part in the "W" temper condition, one in which it is quite soft and ductile. However, the "W" condition is an unstable one at room temperature, and the part will "age" or harden in a matter of hours if nothing further is done. For this reason the part is perferrably refrigerated until further work is to be done on it. The final part of this step is to again stretch form the part, using the same forming die, to cold work the part to a minor extent, e.g., 1 ½ to 2% elongation, to put it in the T3 temper condition.

The third step is simply an artificial aging, e.g., heating the part to a somewhat elevated temperature (less than for annealing or solution heat treating) and holding it there for a limited time. Since this step hastens the precipitation of intermetallic compounds at the grain boundaries (and also controls the size and spacing of such precipatates), it is also known as "precipitation heat treating."

BRIEF DESCRIPTION OF THE DRAWING FIGURES

The present documents include an accompanying drawing, the purposes of which are to give the reader some idea of the complexity of shape of the aluminum parts provided by the present invention, and some idea of the stretch forming process. In the drawing:

FIG. 1 is a front elevation of the stretch forming equipment, shown in use with an aluminum part being formed; and FIG. 2 is an isometric view of the forming die and part formed thereon.

DETAILED DESCRIPTION OF THE INVENTION

In this section it is proposed not to repeat the general description above, which would be sheer redundancy. Rather, the drawing figures will be described, a specific example will be furnished and, finally, comments will be made on the extent to which the various steps in the claimed process may be varied, omitted or otherwise changed.

In FIG. 1 the sheet aluminum workpiece 10 is shown being forced to conform to the upper surface 12 of die block 14 under the influence of pulling forces exerted on its opposed edge portions 16 by the gripping jaws 18 secured to the ends of pistons rods 20 extending from the pair of opposed hydraulic cylinders 22 pivotally secured to fixed blocks 24 at pivot points 26. Blocks 24 may be thought of as containing the necessary additional components of a hydraulic system (pump, sump, conduits, etc.), together with servomechanisms and other control equipment responsive to controls at a nearby operator's console (not shown).

The forming die 14 rests on a horizontal table 28 which in turn is supported on the horizontal member 32 supported by a multiplicity of vertical legs 34 which are, in effect, hydraulic jacks or rams. As indicated by the arrows on these members, such legs can be moved up or down, as dictated by the shape 12 of the forming die and the skill of the operator.

FIG. 2 vividly portrays the intricate shape of the workpiece 10, as determined by the carefully machined surface 12 of die block 14. It will be evident from this figure that the shape is compound curved, i.e., in both length and width, and that there is little symmetry to ease the fabricator's task. The only constant is the thickness of workpiece 10. For a part of the overall process, the surface of workpiece 10 is marked with the two sets of mutually orthogonal grid lines 36 and 38. These are added after the initial stretch forming step, and are used to measure and monitor elongation during the secondary stretching, so that elongation may be better controlled. By this means, the operator may control the cold working and thus the final temper of the workpiece. While not essential to a highly skilled operator, grid lines 36 and 38 are a valuable monitoring means, especially with first run, experimental pieces.

The workpiece 10 illustrated in the drawing represents the part from which one half of the upper panel of an explosively actuated emergency exit for a manned-shuttlecraft is made. The part measures 120 inches in length by 48 inches wide by ⅜ths-inch thick (305 cm. X 122 cm. X 0.952 cm.). In a later stage of preparation, such panel will be machined along closed contours which define the outer periphery of the piece to be blown out upon detonation of an explosive charge, and for this reason it is important that the metal rupture cleanly, rather than fracturing randomly and haphazardly.

In addition, the use of the panel 10, considering such factors as environment, speed, acceleration and vibration, is such that a high degree of stress corrosion resistance is necessary. Altogether, these requirements dictate a T851 temper in the finished part.

The blank in annealed condition was disposed in the stretch forming equipment illustrated in the drawing, mounted on the die block, and stretch formed to the shape indicated.

The grid lines shown in the drawing were then added, for later use, the same being curvilinear squares with 12 inch (30.5 cm.) sides. The major elongation is the lengthwise direction, between clamps 18, and is measured by the changes in distance between the grid lines 36 running across the part. Although there is relatively little elongation athwart the canopy, the longitudinal grid lines 38 provide the lines along which longitudinal elongation may be conveniently measured.

The part was then moved to a heat treating facility and solution heat treated by the currently standard industry process as described in the specification MIL-H-6088. Once the piece had been quenched as required for solution heat treating, it was removed and refrigerated at approximately 110° F (−79° C) by packing it in solid $CO_2$ and allowing it to remain there to prevent room temperature hardening prior to the second stretching.

At such time, the refrigerated part was moved to the same stretch forming equipment, placed on the forming die, and stretched until a permanent elongation of 1 ½ to 2% was reached. This causes enough cold working to change the condition of the part to achieve a T3 temper. Elongation was measured during this step, by use of the grid lines, as discussed above, and the fact that the T3 condition had been attained was verified by a subsequent mechanical properties test.

Finally, the panel was brought to the T8 temper by the artificial age hardening (precipitation heat treatment) discussed above using the currently standard industry process as described in the specification MIL-H-6088. The fact that it then had a T8 temper was experimentally determined by a mechanical properties test.

It is to be understood that the invention as above described and as partially portrayed in the drawing is illustrative only. Now that the present inventor has disclosed a new concept, many variations and equivalents will occur to those skilled in the art. It should be kept in mind that the present invention is broadly that of obtaining an aluminum alloy part of intricate shape in a very high hardness and high stress corrosion resistance by first forming it to essentially its finished form and dimensions while it is in a very soft condition, solution heat treating and refrigerating it to retard aging and maintain it in a very soft condition, running the piece through the same forming equipment to partially harden it by cold work, and finally using a standard precipitation heat treatment to obtain the ultimate high hardness desired. The invention should be viewed as thus broadly stated, and should not be limited except as set forth in the following claims.

What is claimed is:

1. A process for producing an aluminum alloy part of intricate design and very high temper and stress corrosion resistance comprising the steps of:

a. forming said part from annealed aluminum alloy to essentially its final shape and dimensions by one of the standard forming operations, such step incidentally causing some work-hardening of said part;
b. making the surface of said part with mutually orthogonal grid lines;
c. solution-heat-treating said part to again induce an annealed condition therein;
d. cold-working said part while in its annealed condition by repeating said forming operation;
e. monitoring elongation of said grid lines during said cold-working step;
f. stopping said cold-working step when said part has achieved elongation of approximately 1½ – 2%; and
g. artificially aging the part to achieve a T8 temper.

* * * * *